US008231410B2

(12) United States Patent
Tung et al.

(10) Patent No.: US 8,231,410 B2
(45) Date of Patent: Jul. 31, 2012

(54) ELECTRICAL CONNECTOR WITH SURFACES WITH EXPOSED GROOVES PERMITTING CONTACTS TO BE ASSEMBLED IN A DIRECTION PERPENDICULAR TO A MATING DIRECTION

(75) Inventors: Chang-Hsien Tung, New Taipei (TW); Kuo-Chun Hsu, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/031,255

(22) Filed: Feb. 21, 2011

(65) Prior Publication Data

US 2011/0207371 A1 Aug. 25, 2011

(51) Int. Cl.
*H01R 13/648* (2006.01)

(52) U.S. Cl. ..... 439/607.01

(58) Field of Classification Search ..... 439/607.01, 439/541.5, 108, 101
See application file for complete search history.

(56) References Cited

U.S. PATENT DOCUMENTS

| | | | | |
|---|---|---|---|---|
| 6,210,218 | B1 * | 4/2001 | Chang | 439/567 |
| 6,447,311 | B1 * | 9/2002 | Hu et al. | 439/108 |
| 6,814,612 | B1 * | 11/2004 | Hu et al. | 439/541.5 |
| 7,025,632 | B2 * | 4/2006 | Hu et al. | 439/606 |
| 7,318,752 | B2 * | 1/2008 | Fujimoto et al. | 439/660 |
| 7,473,136 | B2 * | 1/2009 | Hu et al. | 439/607.01 |
| 7,588,458 | B2 * | 9/2009 | He et al. | 439/541.5 |
| 8,070,529 | B2 * | 12/2011 | Xiong et al. | 439/676 |

FOREIGN PATENT DOCUMENTS

TW M359100 6/2009

* cited by examiner

*Primary Examiner* — Chandrika Prasad
(74) *Attorney, Agent, or Firm* — Andrew C. Cheng; Wei Te Chung; Ming Chieh Chang

(57) ABSTRACT

An electrical connector includes a metallic shell defining a mating frame and a shielding portion, a bracket assembled to the shielding portion of the shell and defining an opening therethrough, and a mating member securely assembled to the bracket and having a front portion accessible from the opening. The mating member includes a first housing having opposite first and second surfaces and defined with first and second receiving grooves respectively, and a plurality of first contacts attached to the first receiving grooves, and a plurality of second contacts attached to the second receiving grooves, before the first housing is inserted into the bracket.

17 Claims, 8 Drawing Sheets

ELECTRICAL CONNECTOR WITH SURFACES WITH EXPOSED GROOVES PERMITTING CONTACTS TO BE ASSEMBLED IN A DIRECTION PERPENDICULAR TO A MATING DIRECTION

BACKGROUND OF THE INVENTION

1. Field of the Invention

The present invention relates to an electrical connector, and more particularly to an electrical connector having a mating member configured with a contact-terminal-attached first housing assembled to a bracket, and which is later assembled to a shell. The assembling processes and steps are therefore simplified.

2. Description of the Related Art

A conventional electrical connector for high data transmission rates such as disclosed in Taiwan Patent No. M359100 issued to Sun et al. on Jun. 11, 2009, defines an insulative housing and two contact modules received in the housing. The housing defines a base portion and a tongue portion extending forwardly from the base portion, and the contact modules each defines a main portion and a plurality of contacting portions forwardly projecting beyond the main portion. During assemblage, the contact modules are assembled to the housing with the contacting portions inserted into the corresponding receiving grooves arranged on the tongue portion and exposed upon the opposite surfaces of the tongue portion.

However, the contacting portions should be aligned with the corresponding receiving grooves accurately. Furthermore, in recent years, the pitch of the connector become smaller and smaller, i.e. each electrical connector is requested to provide more and more contacts for meeting high data transmission rate requirement and the large numbers of contacts are hardly to be aligned with the corresponding receiving grooves while assemblage. The large numbers of contacts also may be deformed while inserted into the corresponding receiving grooves.

Therefore, an improved electrical connector with simple assemblage and steady configuration is highly desired.

SUMMARY OF THE INVENTION

An object of the present invention is to provide an electrical connector with simplified assemblage and robust configuration.

In order to achieve the above-mentioned object, an electrical connector includes a metallic shell defining a mating frame and a shielding portion, a bracket assembled to the shielding portion of the shell and defining an opening therethrough, and a mating member securely assembled to the bracket and having a front portion accessible from the opening. The mating member includes a first housing having opposite first and second surfaces and defined with first and second receiving grooves respectively, and a plurality of first contacts attached to the first receiving grooves, and a plurality of second contacts attached to the second receiving grooves, before the first housing is inserted into the bracket.

Other objects, advantages and novel features of the invention will become more apparent from the following detailed description of the present embodiment when taken in conjunction with the accompanying drawings.

DETAILED DESCRIPTION OF THE INVENTION

Figure 1:
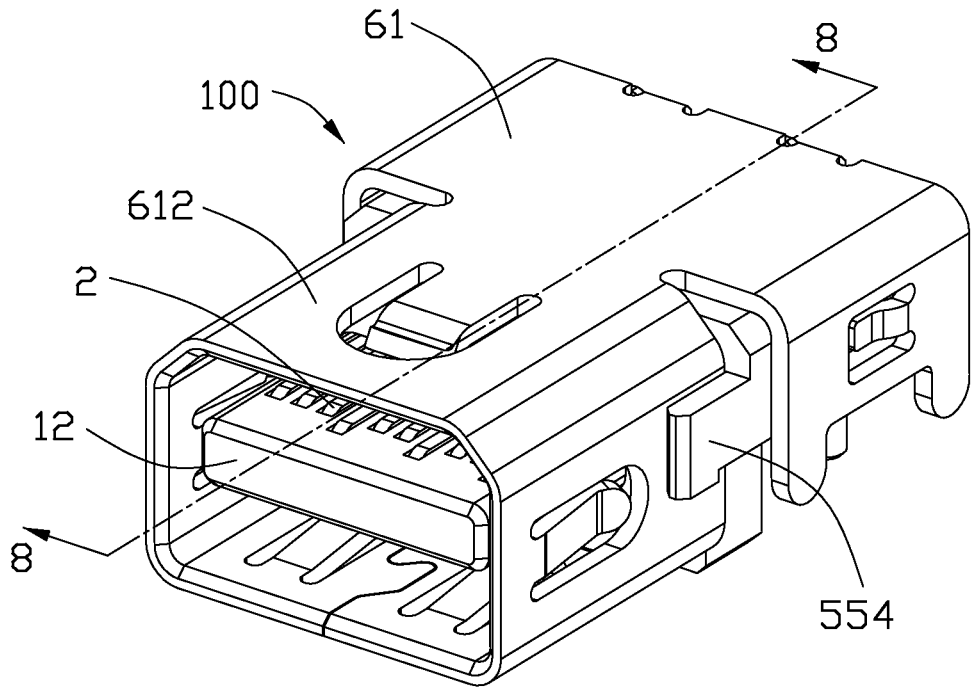
FIG. 1 is an assembled, perspective view of an electrical connector in accordance with the present invention.

Reference will now be made to the drawing figures to describe the preferred embodiments of the present invention in detail.

Figure 2:
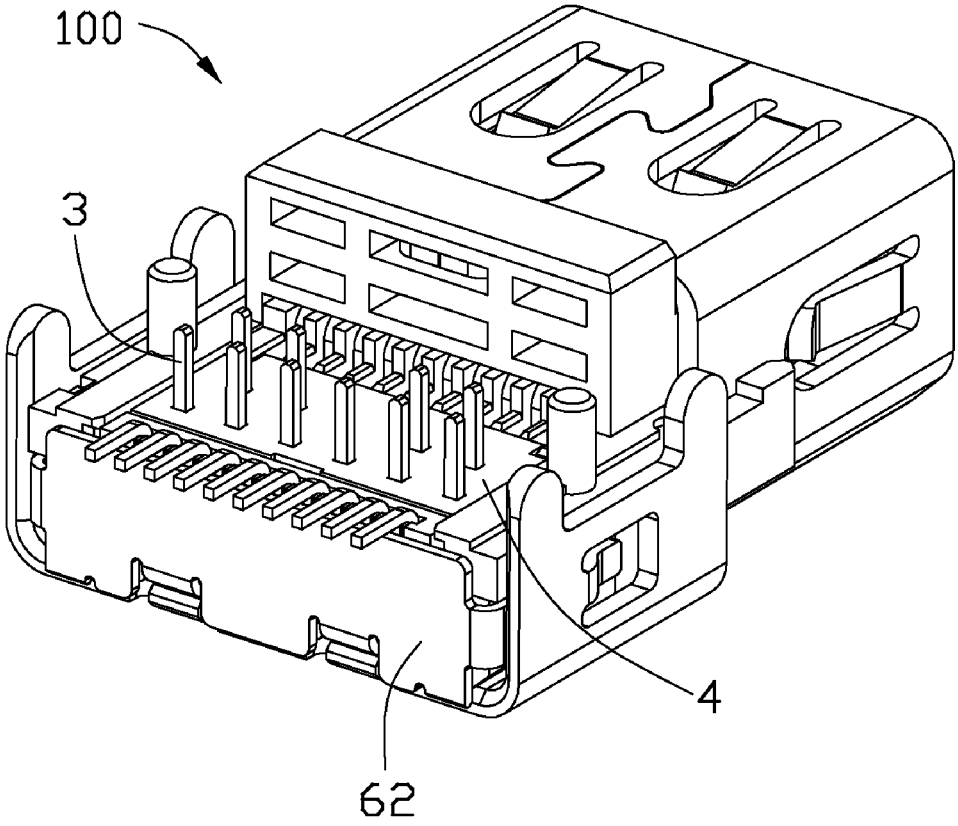
FIG. 2 is another assembled, perspective view of the electrical connector shown in FIG. 1.
Figure 3:
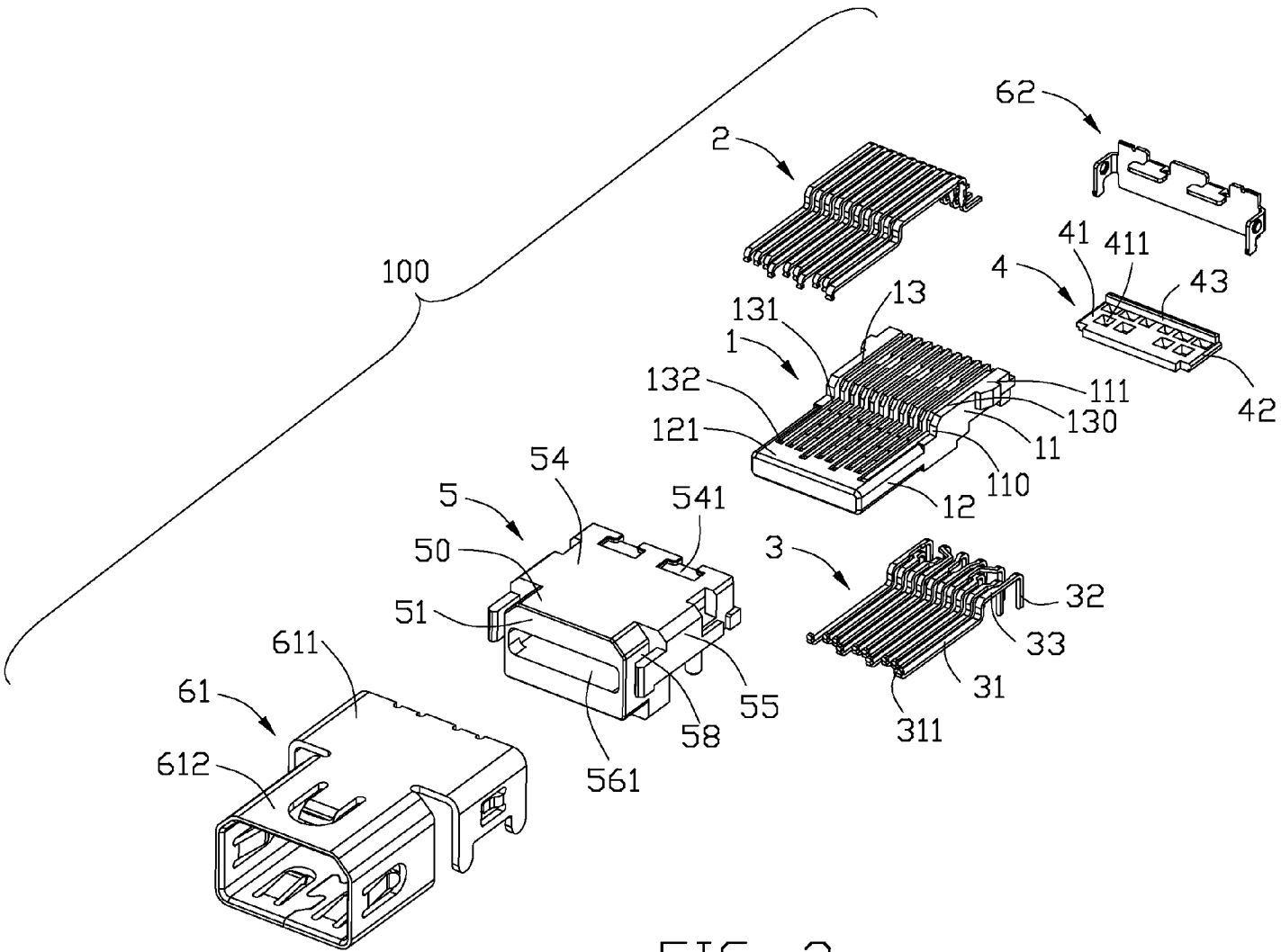
FIG. 3 is an exploded perspective view of the electrical connector shown in FIG. 1.
Figure 4:
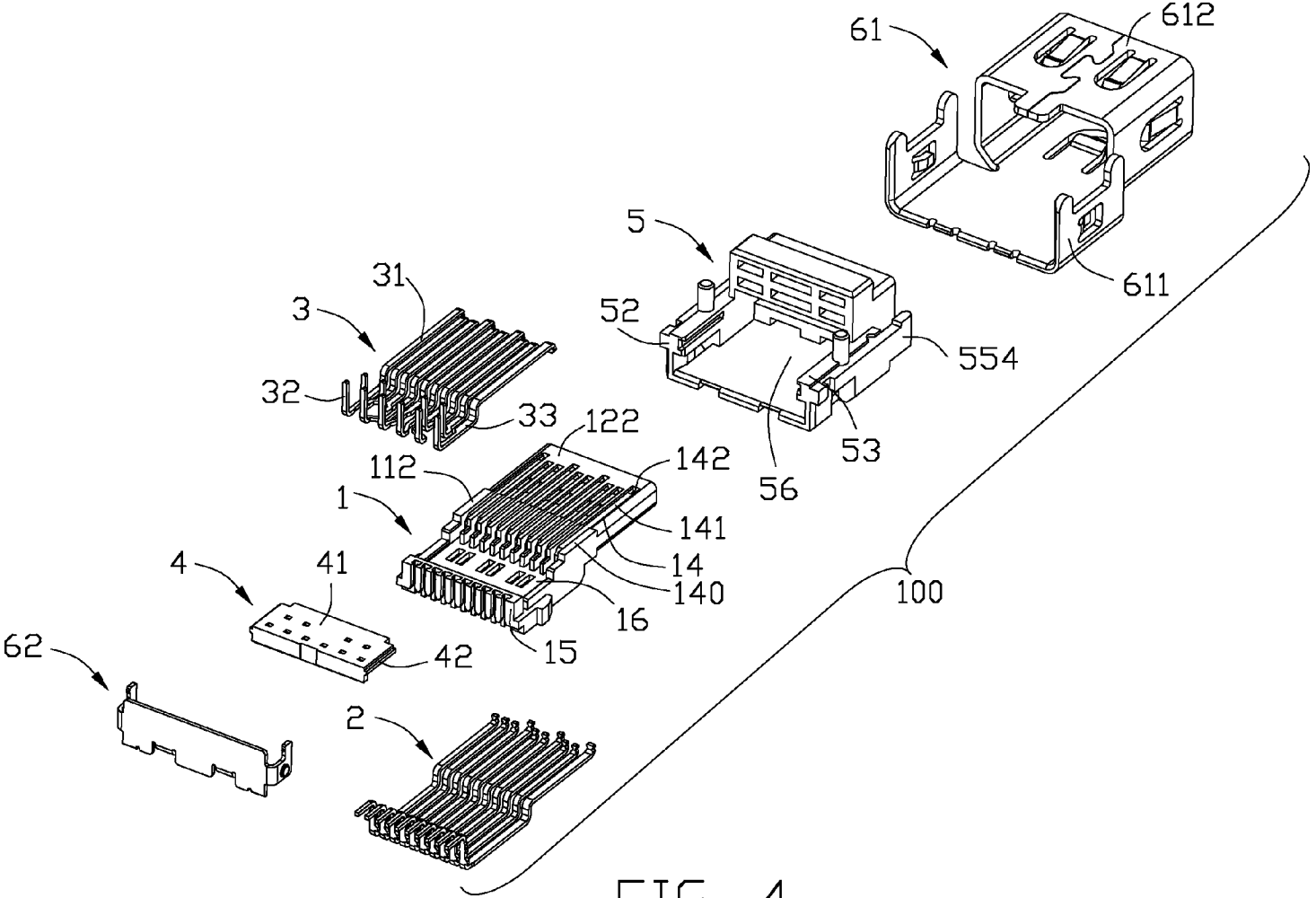
FIG. 4 is another exploded perspective view of the electrical connector shown in FIG. 3.
Figure 5:
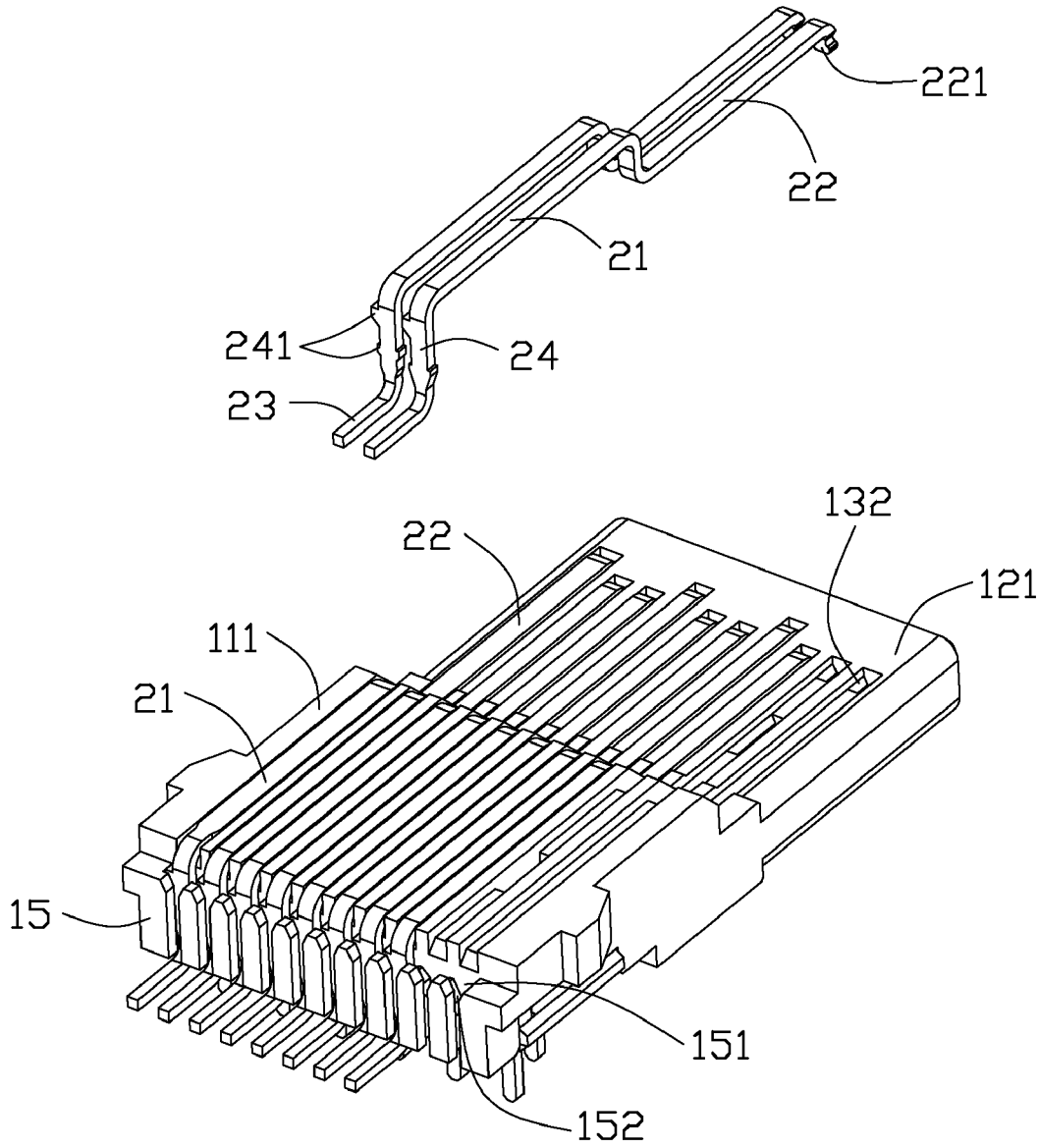
FIG. 5 is a perspective view of a mating member retaining a spacer at a bottom portion thereof with two first contacts separated from a first housing shown in FIG. 3.
Figure 6:
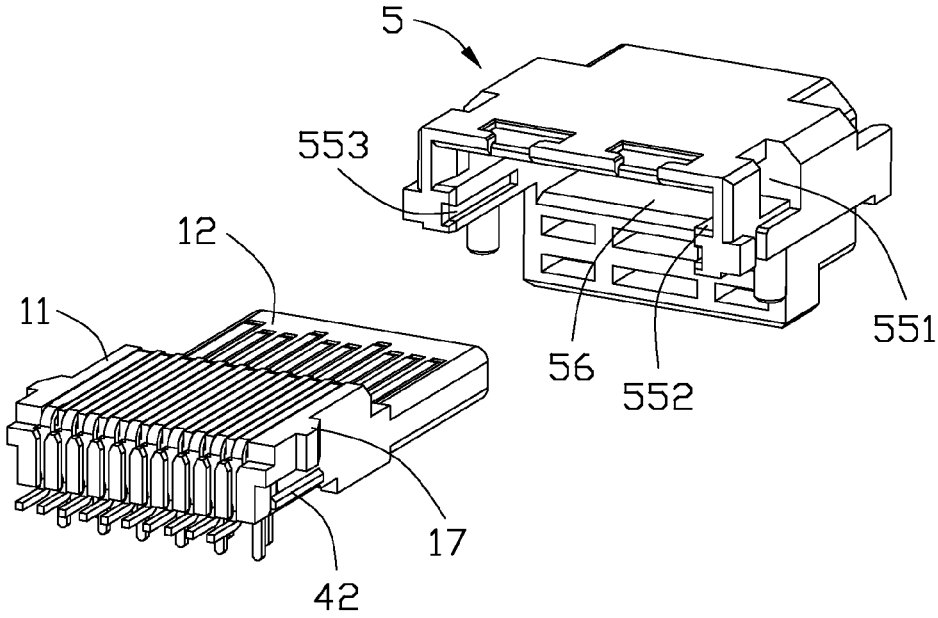
FIG. 6 is a perspective view of the mating member retaining a spacer at a bottom portion thereof and separated from a bracket shown in FIG. 3.

Referring to FIG. 1 to FIG. 3, disclosed here is an electrical connector 100 made in accordance with the present invention. The electrical connector 100 includes a first insulative housing 1, contacts retained to the first housing 1, a spacer 4 disposed at a bottom portion of the first housing 1, a bracket 5 retained to the first housing 1 and a metallic shell surrounding the first housing 1 and the bracket 5.

Referring to FIG. 3 to FIG. 7, the first housing 1 defines a base portion 11 and a mating portion 12 extending forward from a front face 110 of the base portion 11. The base portion 11 defines opposite first and second supporting faces 111, 112, and the mating portion 12 defines opposite first and second mating faces 121, 122. The first supporting face 111 and the first mating face 121 are parallel to each other and disposed at an upper side of the mating portion 12, and the second supporting face 112 and the second mating face 122 are parallel to each other and disposed at a lower side of the mating portion 12. The first supporting face 111 and the first mating face 121 respectively connect with the front face 110 to define a first surface 130 of the first housing 1, and the second supporting face 112 and the second mating face 122 respectively connect with the front face 110 to define a second surface 140 of the first housing 1 opposite to the first surface 130. A plurality of first receiving grooves 13 downwardly recess towards the second surface 140 from the first surface 130 and each provides a first opening 131 at the first surface 130 thereof. A plurality of second receiving grooves 14 upwardly recess towards the first surface 130 from the second surface 140 and each provides a second opening 141 at the second surface 140 thereof. Each of the first receiving grooves 13 defines a first retaining slot 132 at a front end thereof and provides a restricting slot 151 at a rear face 15 of the base portion 11. Each of the second receiving grooves 14 defines a second retaining slot 142 at a front end thereof. The base portion 11 defines a receiving room 16 recessed upwardly from the first supporting face 111 at a rear portion thereof.

The contacts include a plurality of first contacts 2 retained to the first receiving grooves 13, and a plurality of second contacts 3 retained to the second receiving grooves 14. Each of the first contact 2 defines a board-shaped first connecting portion 21, a stiff first contacting portion 22 bending downwardly and then extending forwardly from a front end of the connecting portion 21, and a locking tail 24 bending downwardly from a rear end of the connecting portion 21, and a soldering portion 23 bending rearwards from the locking tail 24. The first contacting portion 22 defines a first locking portion 221 at a front end thereof. Each of the second contact 3 defines a stiff second contacting portion 31, a second connecting portion 33 bending upwardly and extending rearwards from a rear end of the second contacting portion 31, and a soldering portion 32 bending downwardly from a rear end of the second connecting portion 33. The second contacting portion 31 defines a second locking portion 311 at a front end thereof. The soldering portions 32 of the second contacts 3 are arranged in two rows in a front-to-rear direction.

Referring to FIGS. 3, 4, 5 and FIG. 8, the first contacts 2 are downwardly assembled into the corresponding first receiving grooves 13 from the first opening 131 disposed at the first surface 130 thereof. The first locking portion 221 locks into the corresponding first retaining slot 132 to make the first contacting portion 22 attach to the mating portion 12 and exposed upon the first mating face 121. The locking tail 24 is received in the restricting slot 151 with the retaining protrusion 241 abutting against the restricting portion 152 to restrict the movement of the locking tail 24, and the connecting portion 21 is exposed upon the first supporting face 111. The second contacts 3 are upwardly assembled into the corresponding second receiving grooves 14 from the second opening 141 disposed at the second surface 140 thereof. The second locking portion 321 locks into the corresponding second retaining slot 142 to make the second contacting portion 31 attach to the mating portion 12 and exposed upon the second surface 140. The second connecting portion 33 is received in the receiving room 16 and attach to a top face of the receiving room 16, and the soldering portion 32 extends out of the receiving room 16. The first housing 1 retaining the plurality of first and second contacts 2, 3 therein is defined as a mating member.

Referring to FIG. 3 to FIG. 6, and FIG. 8, the spacer 4 defines a rectangular mainly body portion 41, two girders 42 each projecting outwards from a side face of the mainly body portion 41, and a retaining portion 43 upwardly rose from a rear portion of the mainly body portion 41. The spacer 4 is upwardly retained in the receiving room 16 by the retaining portion 43 running into and retained in a retaining slot 161 disposed in the receiving room 16 thereof. The girders 42 project out of the receiving room 16 and further extend beyond the side face of the base portion 11. The second connecting portions 33 are sandwiched between the base portion 11 and the spacer 4, and the soldering portions 32 run through the corresponding retaining holes 411 disposed in the mainly body portion 41 to extend out of the spacer 4.

Referring to FIG. 3 to FIG. 7, the bracket 5 defines a front face 51, a rear face 52 opposite to the front face 51, a bottom face 53 defined as a fixing face, a top face 54 facing to the bottom face 53, and a pair of sidewalls 55 connecting with the bottom and top faces 53, 54. A receiving portion 56 is recessed rearwards from the front face 51 to run through the rear face 52 and a rear portion of the bottom face 53, and the receiving portion 56 provides an opening 561 at the front face 51 thereof. The sidewalls 55 each defines a locking hole 551 at a rear portion thereof for communicating with the receiving portion 56, a supporting portion 552 extending towards the receiving portion 56 from an inner face of the sidewall 55, and a receiving slot 553 disposed under the supporting portion 552.

The mating member retaining with the spacer 4 is inserted into the receiving portion 56 from the rear face 52 of the bracket 5, and the hooking portions 17 extending outwards from the side face of the base portion 11 are supported by the corresponding supporting portions 552, the girders 42 are received in the receiving slots 553. For further assemblage, the girders 42 slide forwardly along the receiving slots 553 until the hooking portions 17 run into the locking holes 551 and lock with the corresponding locking holes 551 to securely retain the base portion 11 in the receiving portion 56, and the mating portion 12 forwardly extends out of the receiving portion 56 from the opening 561 thereof. The bracket 5 provides a smaller retaining frame 50 at a front portion thereof, and the sidewalls 55 each provides a locking arm 554 extending forwardly to dispose outside the retaining frame 50. The locking arm 554 is spaced from the retaining frame 50 to provide a clipping slot 58 therebetween.

Figure 7:
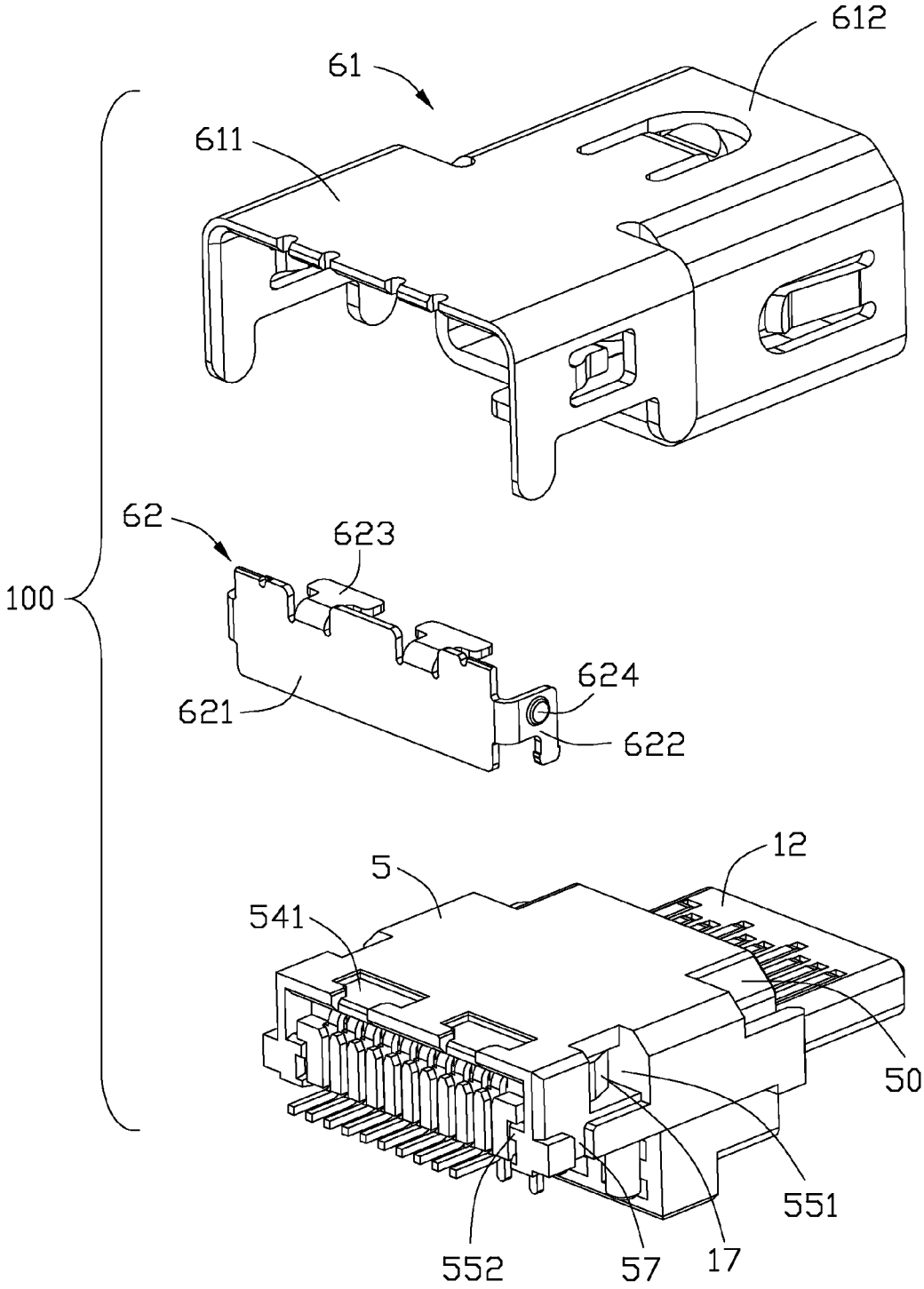
FIG. 7 is a partly exploded perspective view of the electrical connector with the shell separated from the first housing and the bracket.
Figure 8:
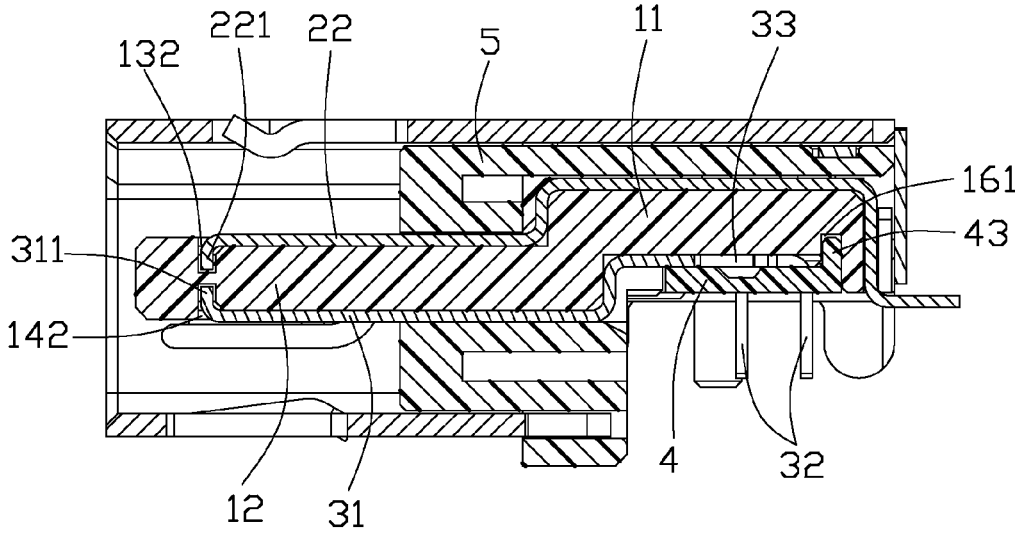
FIG. 8 is a cross-sectional view taken along line 8-8 of FIG. 1.

Referring to FIG. 1 and FIG. 7, the metallic shell includes a first shell 61 and a second shell 62 connecting with the first shell 61. The first shell 61 defines a shielding portion 611 surrounding the bracket 5, and a mating frame 612 connecting with the shielding portion 611. The second shell 62 defines a shielding plate 621, two fixing legs 622 each extending from a side edge of the shielding plate 621 and a pair of T-shaped locking parts 623 bending forward from a top edge of the shielding plate 621. The second shell 62 is downwardly assembled from the top face 54 and retained to the bracket 5 by the locking parts 623 locking into the corresponding T-shaped locking slots 541 disposed in the top face 54, and the fixing legs 622 fixed in the corresponding slots 57 each disposed at a rear portion of the sidewall 55, and the shielding plate 621 shields the rear face 15 of the first housing 1. The first shell 61 is assembled rearwards from the front face 51 of the bracket 5, the shielding portion 611 surrounds the bracket 5 and contacts with the contacting points 624 of the second shell 62, the rear portion of the mating frame 612 runs into the clipping slot 58 and abuts against the locking arm 554 to be restricted in the clipping slot 58. The mating portion 12 and the retaining frame 50 are disposed in the mating frame 612. The electrical connector 100 is provided after the assembling or manufacturing processes and steps mentioned above, and the method for manufacturing the electrical connector 100 is simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a metallic shell defining a mating frame and a shielding portion;

a bracket assembled to the shielding portion of the shell, and defining an opening therethrough;

a mating member securely assembled to the bracket and having a front portion accessible from the opening in a mating direction, and including:

a first housing having opposite first and second surfaces and defined with first and second receiving grooves respectively; and a plurality of first contacts attached to the first receiving grooves, and a plurality of second contacts attached to the second receiving grooves, before the first housing is inserted into the bracket, wherein each first receiving groove is recessed towards the second surface from the first surface and provides a first opening exposed upon the first surface for permitting the first contact assembled theretrough in a vertical direction perpendicular to the mating direction to expose on the first surface.

2. The electrical connector as described in claim 1, wherein each second receiving groove is recessed towards the first surface from the second surface and provides a second opening at the second surface thereof, and the plurality of second contacts are assembled into the corresponding second receiving grooves from the second openings in a vertical direction perpendicular to the mating direction and expose on the second surface.

3. The electrical connector as described in claim 2, wherein the first housing defines a base portion and a mating portion forwardly extending from a front face of the base portion, the base portion defines opposite first and second supporting faces, and the mating portion defines opposite first and second mating faces, the first surface includes the first supporting face and the first mating face, and the second surface includes the second supporting face and the second mating face, the plurality of first contacts expose on both the first supporting face and the first mating face, the plurality of second contacts expose on both the second supporting face and the second mating face.

4. The electrical connector as described in claim 3, wherein the mating portion extends through the opening of the bracket to be exposed in front of the bracket and expose the corresponding first and second mating faces.

5. The electrical connector as described in claim 4, wherein each first contact defines a first connecting portion exposed on the first supporting face, a first contacting portion bending from a front end of the connecting portion and exposed on the first mating face, and a first soldering portion.

6. The electrical connector as described in claim 5, wherein the first contacting portion defines a first locking portion at a front end thereof for locking into a first retaining slot defined at a front end of each first receiving groove.

7. The electrical connector as described in claim 6, wherein each first contact defines a locking tail connecting with the first connecting portion and the first soldering portion, and the first receiving groove defines a restricting slot at a rear face of the base portion for retaining the locking tail.

8. The electrical connector as described in claim 7, wherein the locking tail defines at least a retaining protrusion at a side edge thereof, and the locking tail is received in the restricting slot with the retaining protrusion abutting against a corresponding restricting portion disposed in the restricting slot.

9. The electrical connector as described in claim 8, wherein each second contact defines a second contacting portion exposed on both the second mating face and the second supporting face, a second soldering portion and a second connecting portion connecting with the second contacting portion and the second soldering portion.

10. The electrical connector as described in claim 9, wherein the second contacting portion defines a second locking portion at a front end thereof for locking into a second retaining slot defined at a front end of each second receiving groove.

11. The electrical connector as described in claim 10, further defining a spacer, and the base portion defines a receiving room recessed towards the first supporting face from the second supporting face, the spacer is retained in the receiving room with the second connecting portion sandwiched between the base portion and the spacer.

12. The electrical connector as described in claim 11, wherein the first housing defines hooking portion projecting outwards at a rear portion thereof, and the spacer defines girders each projecting outwards from a side face thereof, and the bracket defines opposite sidewalls disposed at two sides of the first housing, each sidewall defines a locking hole for locking with the hooking portion and a receiving slot for receiving and retaining the girder.

13. The electrical connector as claimed in claim 10, wherein the first soldering portions are arranged in one row, the second soldering portions are arranged in two rows and located in front of the first soldering portions.

14. The electrical connector as claimed in claim 13, wherein the first soldering portions define surface mount tail sections, and the second soldering portions define through hole tail sections.

15. An electrical connector comprising:

an insulative housing defining a base portion and a mating portion extending forwardly from the base portion in a mating direction, and further defining opposite upper and bottom faces in a vertical direction perpendicular to said mating direction;

a plurality of upper grooves formed in and upwardly exposed upon the upper face;

a plurality of bottom grooves formed in and downwardly exposed upon the bottom face;

a plurality of upper contacts configured to be only downwardly assembled into the corresponding upper grooves, respectively;

a plurality of bottom contacts configured to be only upwardly assembled into the corresponding bottom grooves, respectively;

an insulative bracket enclosing the base portion and defining a through opening through which the mating portion forwardly extends; and a metallic shell including a shielding portion enclosing the bracket, and a mating frame extending forwardly from the shielding portion and enclosing the mating portion.

16. The electrical connector as claimed in claim 15, wherein the upper contacts define one row surface mount tail sections, and the bottom contacts define two rows through hole tail sections in front of said one row surface mount tail sections.

17. The electrical connector as claimed in claim 15, wherein the upper contacts and the bottom contacts define corresponding stiff contacting portions each equipped with a locking portion about a distal end.

* * * * *